US007472433B2

(12) United States Patent
Rodenbeck et al.

(10) Patent No.: US 7,472,433 B2
(45) Date of Patent: Jan. 6, 2009

(54) METHOD AND APPARATUS FOR DETERMINING WHEN HANDS ARE UNDER A FAUCET FOR LAVATORY APPLICATIONS

(75) Inventors: Robert Wilmer Rodenbeck, Indianapolis, IN (US); Brian D. Rau, Cincinnati, OH (US)

(73) Assignee: Masco Corporation of Indiana, Indianapolis, IN (US)

( * ) Notice: Subject to any disclaimer, the term of this patent is extended or adjusted under 35 U.S.C. 154(b) by 528 days.

(21) Appl. No.: 11/325,927

(22) Filed: Jan. 5, 2006

(65) Prior Publication Data

US 2007/0156260 A1 Jul. 5, 2007

(51) Int. Cl.

| | |
|---|---|
| ***E03C 1/05*** | (2006.01) |
| ***E03C 1/04*** | (2006.01) |
| ***F16K 11/14*** | (2006.01) |
| ***F16K 21/00*** | (2006.01) |
| ***F16K 31/12*** | (2006.01) |
| ***F16K 31/02*** | (2006.01) |
| ***G05D 7/00*** | (2006.01) |

(52) U.S. Cl. ..... 4/623; 4/678; 137/607; 137/801; 700/282; 250/221; 250/338.1; 250/341.8; 250/353; 251/12; 251/129.04

(58) Field of Classification Search ..... 4/619, 4/623, 675–678; 137/1, 605, 607, 624.11, 137/801; 73/861.57; 250/200, 216, 221, 250/336.1, 338.1, 341.8, 353; 251/12, 129.01, 251/129.04; 700/282

See application file for complete search history.

(56) References Cited

U.S. PATENT DOCUMENTS 4,688,277 A 8/1987 Kakinoki et al.

(Continued)

FOREIGN PATENT DOCUMENTS

DE 3339849 5/1985

(Continued)

OTHER PUBLICATIONS

Toto® Products, "Self-Generating EcoPower System Sensor Faucet, Standard Spout," Specification Sheet, Nov. 2002, 2 pgs.

(Continued)

*Primary Examiner*—Crystal J Bullock
(74) *Attorney, Agent, or Firm*—Leon E. Redman; Lloyd D. Doigan

(57) ABSTRACT

A method of controlling a flow of liquid includes calibrating a PSD infrared sensor associated with the spout. The calibrating includes turning on the spout to thereby dispense a stream of liquid from the spout and into a stream space; emitting infrared energy from the PSD infrared sensor and toward the stream of liquid; sensing a first position of the infrared energy after the infrared energy has been reflected back to the sensor from the stream of liquid; storing first information based upon the first position of the reflected infrared energy; turning off the spout to thereby inhibit the liquid from being dispensed from the spout; sensing a second position of the infrared energy after the infrared energy has been reflected back to the sensor from an object that is fixed relative to the sensor; and storing second information based upon the second position of the reflected infrared energy. Infrared energy is emitted from the PSD infrared sensor and toward the stream space. A third position of the infrared energy after the infrared energy has been reflected back to the sensor is sensed. The spout is controlled dependent upon the first information, the second information and the third position.

20 Claims, 6 Drawing Sheets

U.S. PATENT DOCUMENTS

| | | | | |
|---|---|---|---|---|
| 4,709,728 | A | 12/1987 | Ying-Chung | |
| 4,823,414 | A | 4/1989 | Piersimoni et al. | |
| 4,826,129 | A | 5/1989 | Fong et al. | |
| 4,869,287 | A | 9/1989 | Pepper et al. | |
| 4,948,090 | A | 8/1990 | Chen | |
| 4,998,673 | A | 3/1991 | Pilolla | |
| 5,025,516 | A | 6/1991 | Wilson | |
| 5,073,991 | A | 12/1991 | Marty | |
| 5,074,520 | A | 12/1991 | Lee et al. | |
| 5,224,509 | A | 7/1993 | Tanaka et al. | |
| 5,243,717 | A | 9/1993 | Yasuo | |
| 5,549,273 | A | 8/1996 | Aharon | |
| 5,555,912 | A | 9/1996 | Saadi et al. | |
| 5,566,702 | A | 10/1996 | Philipp | |
| 5,570,869 | A | 11/1996 | Diaz et al. | |
| 5,758,688 | A | 6/1998 | Hamanaka et al. | |
| 5,781,942 | A | 7/1998 | Allen et al. | |
| 5,918,855 | A | 7/1999 | Hamanaka et al. | |
| 5,934,325 | A | 8/1999 | Brattoli et al. | |
| 5,966,753 | A | 10/1999 | Gauthier et al. | |
| 5,979,500 | A | 11/1999 | Jahrling et al. | |
| 6,003,170 | A | 12/1999 | Humpert et al. | |
| 6,082,407 | A | 7/2000 | Paterson et al. | |
| 6,127,671 | A | 10/2000 | Parsons et al. | |
| 6,135,146 | A | 10/2000 | Koganezawa et al. | |
| 6,161,814 | A | 12/2000 | Jahrling | |
| 6,192,530 | B1 | 2/2001 | Dai | |
| 6,202,980 | B1 | 3/2001 | Vincent et al. | |
| 6,220,297 | B1 | 4/2001 | Marty et al. | |
| 6,273,394 | B1 | 8/2001 | Vincent et al. | |
| 6,294,786 | B1 | 9/2001 | Marcichow et al. | |
| 6,363,549 | B2 | 4/2002 | Humpert et al. | |
| 6,381,770 | B1 | 5/2002 | Raisch | |
| 6,393,634 | B1 | 5/2002 | Kodaira et al. | |
| RE37,888 | E | 10/2002 | Cretu-Petra | |
| 6,513,787 | B1 | 2/2003 | Jeromson et al. | |
| 6,588,453 | B2 | 7/2003 | Marty et al. | |
| 6,639,209 | B1 | 10/2003 | Patterson et al. | |
| 6,691,340 | B2 | 2/2004 | Honda et al. | |
| 6,710,346 | B2 * | 3/2004 | Brewington et al. | 250/341.8 |
| 6,738,996 | B1 | 5/2004 | Malek et al. | |
| 6,757,921 | B2 | 7/2004 | Esche | |
| 6,763,731 | B1 * | 7/2004 | Padden | 73/861.57 |
| 6,768,103 | B2 | 7/2004 | Watson | |
| 6,770,869 | B2 | 8/2004 | Patterson et al. | |
| 6,845,526 | B2 | 1/2005 | Malek et al. | |
| 6,877,172 | B2 | 4/2005 | Malek et al. | |
| 6,956,498 | B1 | 10/2005 | Gauthier et al. | |
| 6,962,168 | B2 | 11/2005 | McDaniel et al. | |
| 6,964,404 | B2 | 11/2005 | Patterson et al. | |
| 6,968,860 | B1 | 11/2005 | Haenlein et al. | |
| 6,985,239 | B2 | 1/2006 | Doucet et al. | |
| 6,996,863 | B2 | 2/2006 | Kaneko | |
| 2004/0084609 | A1 | 5/2004 | Bailey | |
| 2004/0104340 | A1 | 6/2004 | Watson | |
| 2004/0135010 | A1 | 7/2004 | Malek et al. | |
| 2004/0144866 | A1 | 7/2004 | Nelson et al. | |
| 2005/0127313 | A1 | 6/2005 | Watson | |
| 2005/0150556 | A1 | 7/2005 | Jonte | |
| 2005/0151101 | A1 | 7/2005 | McDaniel et al. | |
| 2006/0200903 | A1 * | 9/2006 | Rodenbeck et al. | 4/623 |

FOREIGN PATENT DOCUMENTS

| | | | |
|---|---|---|---|
| EP | 0 409 998 | B1 | 11/1995 |
| EP | 1 132 530 | A2 | 9/2001 |
| EP | 0 685 604 | B1 | 3/2003 |
| GB | 2 264 557 | | 9/1993 |
| WO | WO 91/17377 | | 11/1991 |
| WO | WO 99/61938 | | 12/1999 |

OTHER PUBLICATIONS

Zurn® Plumbing Products Group, "AquaSense® Z6903 Series", Installation, Operation, Maintenance and Parts Manual, Aug. 2001, 5 pgs.

Zurn® Plumbing Products Group, "AquaSense® Sensor Faucet," Jun. 9, 2004, 2 pgs.

Sloan® Optima® i.q. Electronic Hand Washing Faucet, Apr. 2004, 2 pgs.

Symmons®, "Ultra-Sense® Battery-Powered, Sensor-Operated Lavatory Faucet S-6080 Series," Oct. 2002, 4 pgs.

Symmons® Commercial Faucets: Reliability With a Sense of Style, 1 pg.

Symmons®, "Ultra-Sense® Sensor Faucets with Position-Sensitive Detection," Aug. 2004, 4 pgs.

Symmons® "Ultra-Sense® Sensor Faucet with Position-Sensitive Detection," ©2001-2002, 2 pgs.

Technical Concepts International, Inc., Capri AutoFaucet® with Surround Sensor™ Technology, 500556, 500576, 500577, (undated), 1 pg.

Technical Concepts, AutoFaucet® with "Surround Sensor" Technology, Oct. 2005, 4 pgs.

Snow, Laser Triangulation Sensors in the Tire Industry, LMI Selcom, undated (5 pgs.).

Grimmett, Flexible Application-Oriented Photoelectric Sensors: The Latest Technologies and Implementation, Omron Electronics LLC, Sep. 1, 2002 (2 pgs.).

Kennedy, The Basics of Triangulation Sensors, CyberOptics Corp., undated (7 pgs.).

Sharp Corporation, Device Specification for 8 bit output distance measuring sensor, Model GP3Y0E001k0F. SPEC. No. ED-04-G112, Issue Oct. 16, 2004 (10 pgs.).

* cited by examiner

METHOD AND APPARATUS FOR DETERMINING WHEN HANDS ARE UNDER A FAUCET FOR LAVATORY APPLICATIONS

BACKGROUND OF THE INVENTION

1. Field of the Invention

The present invention relates to faucets, and, more particularly, to electronic activation systems for faucets.

2. Description of the Related Art

The state of the art in electronic activation of plumbing faucets utilizes infrared (IR) sensors to determine whether a user is placing his hands or some object such as dishes under the spout. The sensor is typically directed to the general area under the spout. If the sensor determines that the user is placing his hands or some object under the faucet, then a controller turns on a flow of water or some other liquid to the spout. When the IR sensor no longer senses the presence of the hand or object under the spout, then the controller turns off the flow of liquid to the spout.

IR sensors typically include an emitter for emitting IR energy, and a receiver for receiving the IR energy after it has been reflected by some object in the path of the emitted IR energy. Known IR sensors for electronically activating faucets are intensity-based in that the sensors detect the presence of a hand or object under the spout based upon an intensity, magnitude or strength of the reflected IR energy received by the receiver. Generally, the greater the intensity of the reflected energy, the more likely it is that a hand or object has been placed under the spout.

A problem with intensity-based IR sensors is that they cannot easily discriminate between various types of scenarios that may occur in the proximity of a sink. For example, intensity-based IR sensors cannot easily discriminate between a hand entering the sink bowl, the water stream, the water stream with hands actively washing in the stream, and static situations such as a pot placed in the sink bowl. Because of this inability to discriminate, the water stream is not always turned on or off when appropriate.

What is needed in the art is a sensor system that can more easily discriminate between different types of static and dynamic situations in the vicinity of a sink so that the flow of water through the spout may be more accurately controlled.

SUMMARY OF THE INVENTION

The present invention provides a faucet arrangement including an IR sensor that detects the distance between the sensor and objects placed in the vicinity of the sink bowl. Thus, the IR sensor may detect not only the presence of hands or objects under the spout, but may also monitor the movement of such hands or objects. The position-sensitive IR sensor thereby provides data that is more useful than the data that can be provided by an intensity-based IR sensor. The better data provided by the position-sensitive IR sensor enables the controller to make better decisions about whether the flow of liquid through the spout should be turned on or off.

More particularly, the present invention may provide an electronic faucet including a delivery spout and a sensor assembly located in the base of the faucet. The sensor assembly may include a position sensing device (PSD) infrared sensor, sometimes referred to as an angle of reflection infrared sensor. This distance sensor is located such that its field of view includes the area in which the user's hands are likely to be located when washing hands in the water stream. The electronic faucet controller is calibrated to know the approximate distance sensor output values for an empty sink with water off, and an empty sink with water on. The calibration is accomplished automatically by reading and averaging a number of sensor measurements with the water off and an empty sink bowl. Water is then turned on for a brief period of time, and additional measurements are taken and averaged. This produces "water off" and "water on" sensor readings that are used to set the turn-on and turn-off thresholds. When the user's hands enter the sink and cross the turn-on threshold distance from the sensor, the water is turned on in anticipation of the user's hands reaching the water stream area.

The invention comprises, in one form thereof, a method of controlling a flow of liquid including calibrating a PSD infrared sensor associated with a spout. The calibrating includes turning on the spout to thereby dispense a stream of liquid from the spout and into a stream space; emitting infrared energy from the PSD infrared sensor and toward the stream of liquid; sensing a first position of the infrared energy after the infrared energy has been reflected back to the sensor from the stream of liquid; storing first information based upon the first position of the reflected infrared energy; turning off the spout to thereby inhibit the liquid from being dispensed from the spout; sensing a second position of the infrared energy after the infrared energy has been reflected back to the sensor from an object that is fixed relative to the sensor; and storing second information based upon the second position of the reflected infrared energy. Infrared energy is emitted from the PSD infrared sensor and toward the stream space. A third position of the infrared energy after the infrared energy has been reflected back to the sensor is sensed. The spout is controlled dependent upon the first information, the second information and the third position.

In another form, the invention comprises a method of controlling a flow of liquid including calibrating a PSD infrared sensor associated with a spout. The calibrating includes turning on the spout to thereby dispense a stream of liquid from the spout; emitting infrared energy from the PSD infrared sensor and toward the stream of liquid; sensing a first position of the infrared energy after the infrared energy has been reflected back to the sensor from the stream of liquid; and storing first information based upon the first position of the reflected infrared energy. After the calibrating, the spout is turned on to thereby dispense a stream of liquid from the spout. With the spout turned on, a second position of the infrared energy after the infrared energy has been reflected back to the sensor is sensed. It is decided whether the spout should be turned off. The deciding is dependent upon the first information and the second position.

In yet another form, the invention comprises a spout arrangement including a spout having an on position in which the spout dispenses a stream of liquid into a stream space and an off position in which the dispensing of the stream of liquid is inhibited. A PSD infrared sensor emits infrared energy toward the stream space, and senses a position of the infrared energy after the infrared energy has been reflected back to the sensor. A controller is in communication with the spout and with the sensor. The controller stores information based upon a position of the reflected infrared energy sensed by the sensor during calibration when the stream of liquid is in the stream space. The spout is turned to the off position dependent upon the stored information and a position of the reflected infrared energy sensed by the sensor during operation.

In a further form, the invention comprises a spout arrangement including a spout having an on position in which the spout dispenses a stream of liquid into a stream space and an off position in which the dispensing of the stream of liquid is inhibited. An infrared sensor includes an emitter for emitting infrared energy toward the stream space, and a receiver for sensing a position of the infrared energy after the infrared energy has been reflected back to the sensor. A controller is in communication with the spout and with the sensor. The controller stores first information based upon a first position of the reflected infrared energy sensed by the sensor during calibration when the stream of liquid is in the stream space. The controller stores second information based upon a second position of the reflected infrared energy sensed by the sensor during calibration when the stream of liquid is absent from the stream space. The spout is moved between the on position and the off position dependent upon the stored first information, the stored second information, and a position of the reflected infrared energy sensed by the sensor during operation.

An advantage of the present invention is that, by using the PSD rather than an intensity-based detector to sense changes in motion, the faucet system is better able to discriminate between different situations and thereby avoid false activation.

Another advantage is that the PSD allows for a quicker response to changes.

Yet another advantage is that the faucet arrangement is able to self-calibrate to its environment.

A further advantage is that the PSD more effectively detects when objects are in the water stream and thus enables the faucet to remain on longer.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
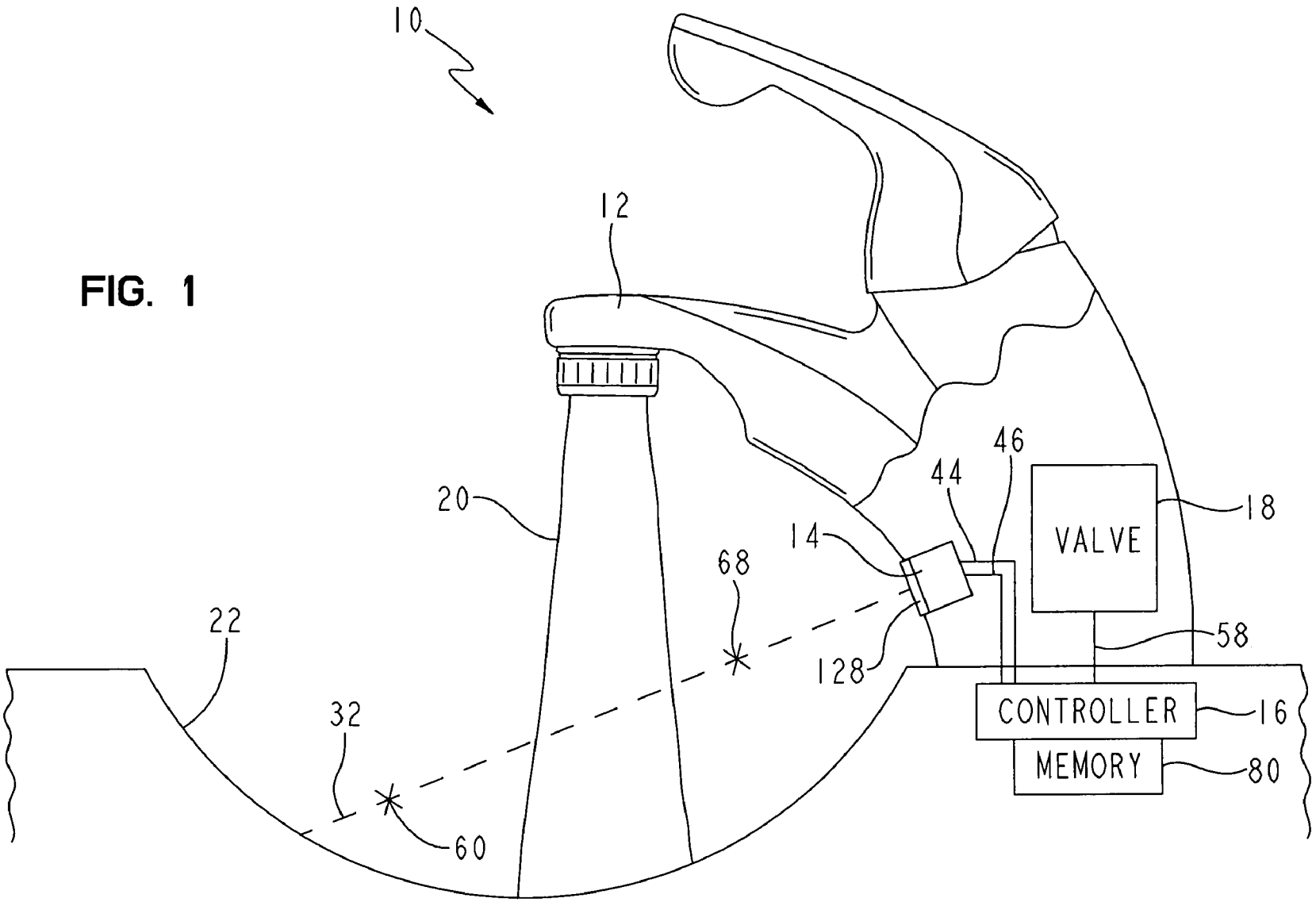
FIG. 1 is a side sectional view of one embodiment of a spout arrangement of the present invention.

Corresponding reference characters indicate corresponding parts throughout the several views. Although the exemplifications set out herein illustrate the invention, in one form, the embodiments disclosed below are not intended to be exhaustive or to be construed as limiting the scope of the invention to the precise form disclosed.

DESCRIPTION OF THE PRESENT INVENTION

Referring now to the drawings, and particularly to FIG. 1, there is shown one embodiment of a spout arrangement 10 of the present invention including a spout 12, a sensing device 14, and a control device 16. Spout 12 includes a valve 18, the position of which determines whether spout 12 delivers or dispenses a flow or stream of liquid 20, such as water, into a sink bowl or basin 22 disposed below spout 12, as is well known. A stream space is defined as the air space between spout 12 and basin 22 that is occupied by stream 20 when stream 20 is flowing.

As shown in the drawings, sensing device 14 may be positioned on a side of spout 12 that is closer to the user when the user is using spout arrangement 10. Sensing device 14 may be in the form of a position sensing device (PSD) infrared (IR) sensor that is capable of sensing a distance that IR energy emitted by sensor 14 travels before being reflected by some object in its path. That is, sensor 14 may determine a distance between sensor 14 and an object that is reflecting IR energy emitted by sensor 14. The terms "reflect" and "reflection", as used herein, may refer to either specular reflection, i.e., direct reflection, or diffuse reflection. However, in one embodiment, sensor 14 may sense the distance between sensor 14 and an object primarily or exclusively based upon the diffuse reflection provided by the object.

Figure 2:
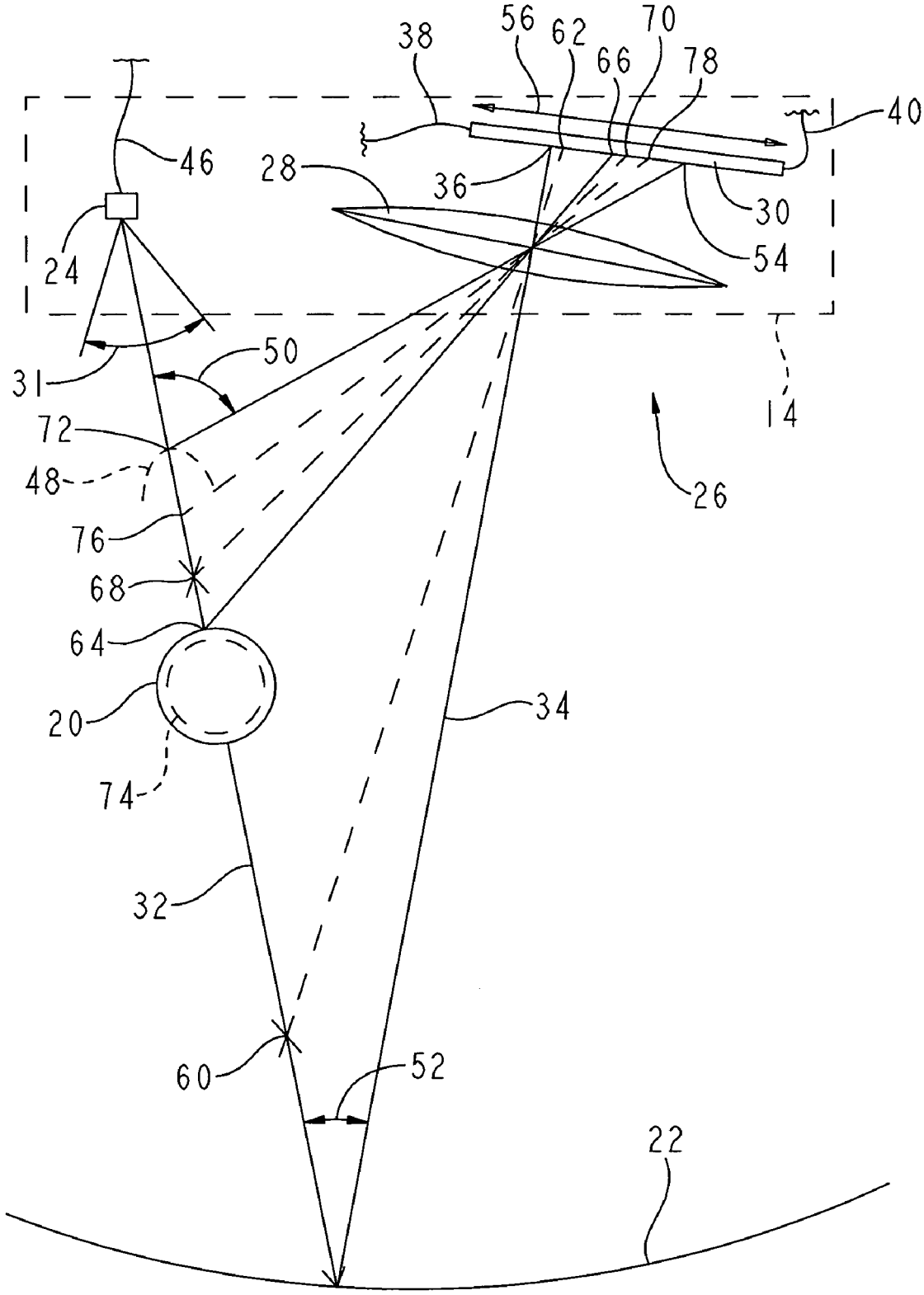
FIG. 2 is an overhead view illustrating operation of the sensor of FIG. 1.

PSD sensor 14 includes an IR energy emitter 24 (FIG. 2) and an analog IR energy receiver 26 having a lens 28 and a detector 30. Receiver 26 may be elongate and may be horizontally oriented, i.e., receiver 26 may extend in a horizontal direction on spout 12, as shown in FIG. 2, which is a simplified schematic illustration of the principle of operation of receiver 26. Emitter 24 may produce a cone-shaped emission of IR energy spanning a cone angle 31 of up to 60 degrees. However, the IR energy may be concentrated along a central cone axis 32 such that the effects of the IR energy that is not along axis 32 are relatively small. Generally, the intensity of the IR emission may decrease as the IR energy is directed farther away from axis 32.

Depending upon the distance between PSD 14 and the reflecting surface, lens 28 focuses the diffusely reflected IR energy at different locations on IR detector 30. Thus, PSD 14 may determine the position of the reflecting surface along axis 32 based upon the location on detector 30 at which the IR energy is received and focused by lens 28. Different distances between emitter 24 and the reflecting surface would result in the reflected IR energy being focused at different, respective locations on detector 30. Although axis 32 is shown in FIG. 2 at a particular angle of orientation relative to stream 20, lens 28 and detector 30, the angle is not critical and may have a wide range of values. It may be desirable, however, to orient emitter 24 and lens 28 such that reflected IR energy is primarily received by lens 28 via diffraction, i.e., such that lens 28 does not receive IR energy primarily via spectral or direct reflection.

In the absence of stream 20 or any other object within basin 22 and in the path of axis 32, the emitted IR energy impinges upon and is reflected off of basin 22. At least a portion of the reflected IR energy is received by lens 28 generally along path 34. Receiver 26 senses the position of the reflected IR energy as impinging upon location 36 of detector 30 after being focused thereat by lens 28. Lens 28 may be oriented, i.e., may face, at the same downward angle, best shown in FIG. 1, at which the IR energy is emitted by emitter 24 along axis 32. Lens 28 may be optically directed or focused at a lateral angle that approximately intersects axis 32. Advantageously, lens 28 may be directed or focused in a direction that approximately intersects axis 32 at a point along axis 32 where a reflecting object is likely to be, such as near stream of liquid 20. With the direction or focus of lens 28 as described above, lens 28 may effectively focus the diffusely reflected IR energy onto detector 30. Sensor 14 may include a secondary outer lens 128, visible in FIG. 3 and visible to a user of spout arrangement 10. Through lens 128 may pass both outgoing IR energy from emitter 24 and incoming reflected IR energy to lens 28.

Figure 4:
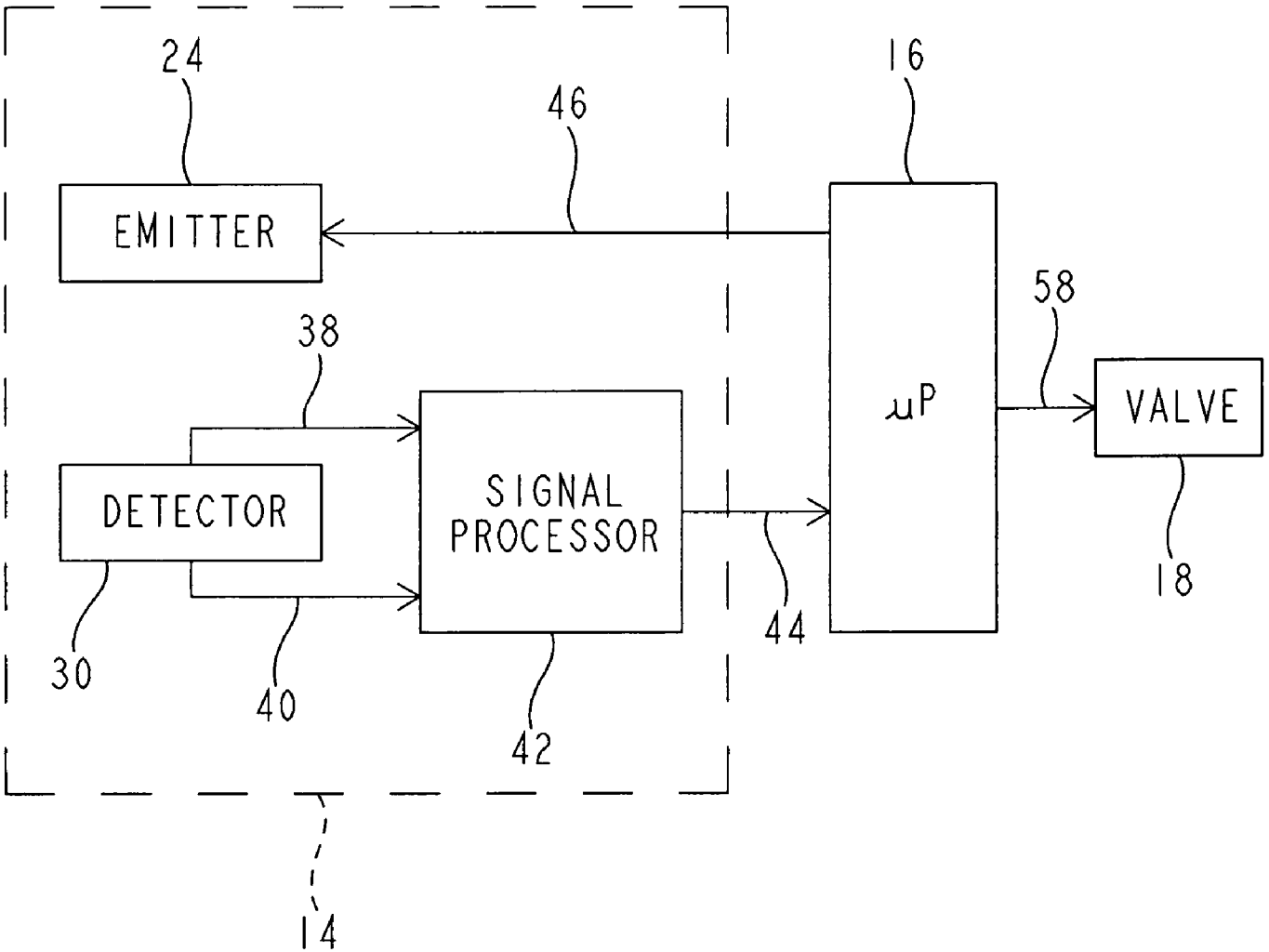
FIG. 4 is an electrical block diagram of the spout arrangement of FIG. 1.

The location along the length of detector 30 at which the IR energy is received may be indicated by the ratio of the output voltage at lead 38 to the output voltage at lead 40. Leads 38, 40 may be connected to a signal processor 42 (FIG. 4) of sensor 14 that reads the voltages and sends a signal dependent thereon to controller 16 on line 44. Sensor 14 may output the distance signal on line 44 at a plurality of points in time to thereby indicate the distance traveled by the IR energy before being reflected at each of the points in time. Thus, the distance signal on line 44 may be modified substantially continuously over time. In one embodiment, controller 16 may sample the distance signal twenty times per second, i.e., every fifty milliseconds. Another lead 46 interconnects emitter 24 and controller 16 such that controller 16 may control the operation of emitter 24.

As indicated in FIG. 2, sensor 14 receives IR energy diffusely reflected from a user's finger 48 at an angle 50 that is larger than an angle 52 at which sensor 14 would receive IR energy diffusely reflected from basin 22, which is farther away from sensor 14 than is finger 48. Because the IR energy reflected from finger 48 is positioned differently than the IR energy reflected from basin 22, lens 28 focuses the IR energy reflected from finger 48 at a location 54 that is different from the location 36 at which lens 28 focuses the IR energy reflected from basin 22.

As mentioned above, the voltages and/or currents at leads 38, 40 of detector 30 may be dependent upon where along a length 56 of detector 30 that the reflected IR energy impinges. For example, the closer the location of the received IR energy to lead 38, the higher the voltage/current that may be produced at lead 38, and the lower the voltage/current that may be produced at lead 40. The analog voltages/currents at leads 38, 40 may be communicated to signal processor 42 of sensor 14, which may output a voltage signal on line 44 to controller 16. The voltage signal on line 44 may be indicative of where along length 56 of detector 30 that the IR energy was received. Electrical power may be supplied to sensor 14 via a power line (not shown) and a ground line (not shown). An example of a position-sensing detector that may be used as sensor 14 of the present invention is an eight bit output distance measuring sensor, model no. GP3Y0E001K0F, sold by Sharp Corporation.

Via a line 58, controller 16 may control a position of valve 18, i.e., open or close valve 18, based upon both the voltage signal on line 44 and the current position of valve 18. The position of valve 18 may, in turn, control a flow of liquid through spout 12. Generally, the shorter the distance that controller 16 determines the IR energy traveled before being reflected, i.e., the shorter the distance between sensor 14 and the reflecting surface, the greater the likelihood that controller 16 will cause valve 18 to be in an open position in which liquid is delivered through spout 12. Thus, controller 16 may control a flow of liquid through spout 12 dependent upon a position of the reflected infrared energy, i.e., dependent upon an angle at which the diffused infrared energy is received by receiver 30. This may be true regardless of whether valve 18 is currently open or closed.

Controller 16 may control the flow of liquid through spout 12 dependent upon the present state of the flow of liquid, i.e., whether valve 18 is open or closed, the measured position of the reflecting object, and a relationship between the measured position of the reflecting object and a threshold position. If valve 18 is closed and flow of liquid 20 is inhibited, i.e., absent, then controller 16 may open valve 18 and cause stream 20 to flow if the reflecting object is closer to emitter 24 than a threshold position 60, which corresponds to a location 62 on receiver 30 at which the reflected IR energy may be focused. A reflecting object being closer than position 60 may be indicative of a hand or other object entering basin 22 for the purpose of being rinsed in stream 20.

If, on the other hand, valve 18 is open and stream 20 is present, then the emitted IR energy may travel no farther than position 64, corresponding to location 66 on detector 30, before being reflected by stream 20. Thus, controller 16 may require that the sensed position of the reflecting object be no farther than a threshold position 68, corresponding to location 70 on detector 30, in order to maintain valve 18 in the open position and keep stream 20 running. If, for example, a user's hands are in stream 20 such that the IR energy is reflected by finger 48 at position 72, corresponding to location 54 on detector 30, then controller 16 may maintain valve 18 in the open position because position 72 is closer to emitter 24 than threshold position 68. In other words, a difference between position 72 and position 64 exceeds a difference between position 68 and position 64.

A fortuitous optical property of a stream 20 of water is that a user's hand placed exactly in water stream 20, that is, at the same distance from emitter 24 as stream 20 itself, reflects the IR energy as if the hand were closer to emitter 24 than is stream 20. For example, a hand placed in stream 20, as schematically indicated at 74 in FIG. 2, may reflect IR energy similarly to a hand alone placed at position 76, corresponding to location 78 on detector 30. This optical property is due to the reflective characteristics of the water. Thus, it is possible to distinguish between a water stream alone and a water stream with an object such as a user's hand in it, and make a decision based thereon whether to turn the water off or not. Threshold position 68 may be chosen such that it is disposed between the reflection position 64 of stream 20 alone and the effective reflection position 76 of a hand in stream 20. Consequently, it is not necessary for the user's hand to move closer to emitter 24 than stream 20 for the water to remain on. The hand need only remain in stream 20 for valve 18 to be kept open and for stream 20 to be kept running.

An exemplary control arrangement that may be used in conjunction with the present invention is disclosed in U.S. patent application Ser. No. 10/755,582, filed Jan. 12, 2004, and entitled "CONTROL ARRANGEMENT FOR AN AUTOMATIC RESIDENTIAL FAUCET", which is incorporated herein by reference. Other aspects of a control arrangement that may be used in conjunction with the present invention are disclosed in U.S. patent application Ser. No. 10/755,581, filed Jan. 12, 2004, and entitled "MULTI-MODE HANDS FREE AUTOMATIC FAUCET", and/or in other applications which are also incorporated herein by reference.

In making the decision whether to open or close valve 18, controller 16 may consider not just one recent reading of detector 30, but may consider several recent readings of detector 30, or several different outputs of signal processor 42. Thus, inappropriate openings or closings of valve 18, such as may be caused by electrical noise or transient spectral reflections, may be avoided. In one embodiment, controller 16 may base the opening and closing of valve upon a mathematical relationship between a plurality of positions sensed by sensor 14 at different respective points in time during operation. More particularly, controller 16 may filter a number of recent data points from signal processor 42 and compare this filtered data to the appropriate threshold position in deciding whether to open or close valve 18. That is, controller 16 may control the flow of liquid through spout 12 dependent upon whether the filtered distance signal exceeds the threshold distance value.

In one embodiment, controller 16 filters the distance signal by calculating a moving average of a number of preceding values of the data from signal processor 42. However, it is also possible for the filtering to include calculating a weighted moving average, or some other type of average, of a number of preceding values of the data from signal processor 42.

Figure 5:
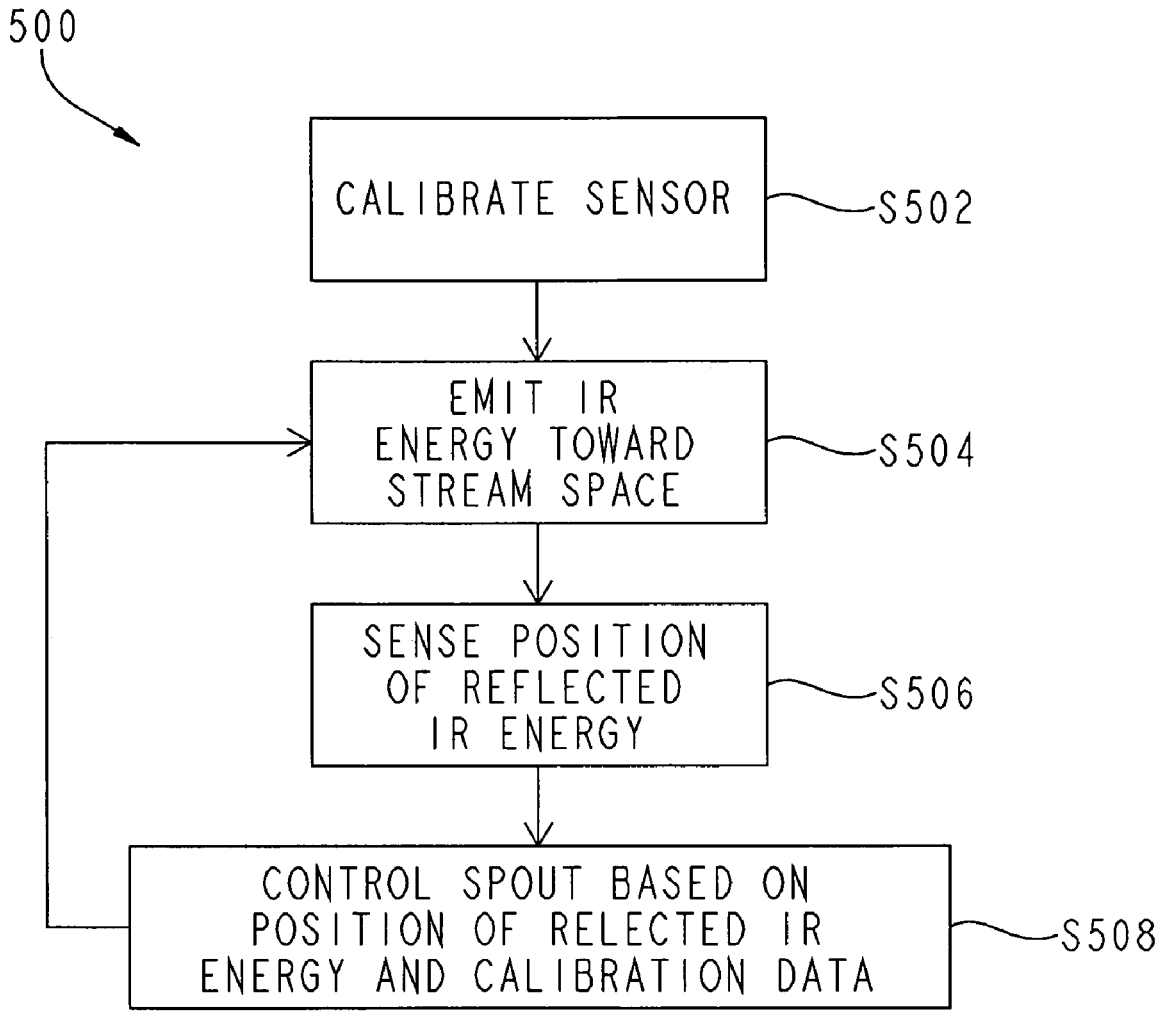
FIG. 5 is a flow chart of one embodiment of a method of operating the spout arrangement of FIG. 1.

FIG. 5 illustrates one embodiment of a method 500 of the present invention of controlling a stream of liquid. In a first step S502, the sensor is calibrated, either manually or spout arrangement 10 may be self-calibrating. Calibrating may include emitting IR energy from emitter 24 and sensing a position of the reflected IR energy both with stream 20 running and with stream 20 being inhibited. These sensor readings may then be used by controller 16 to calculate or otherwise establish threshold positions 60 and 68.

Figure 3:
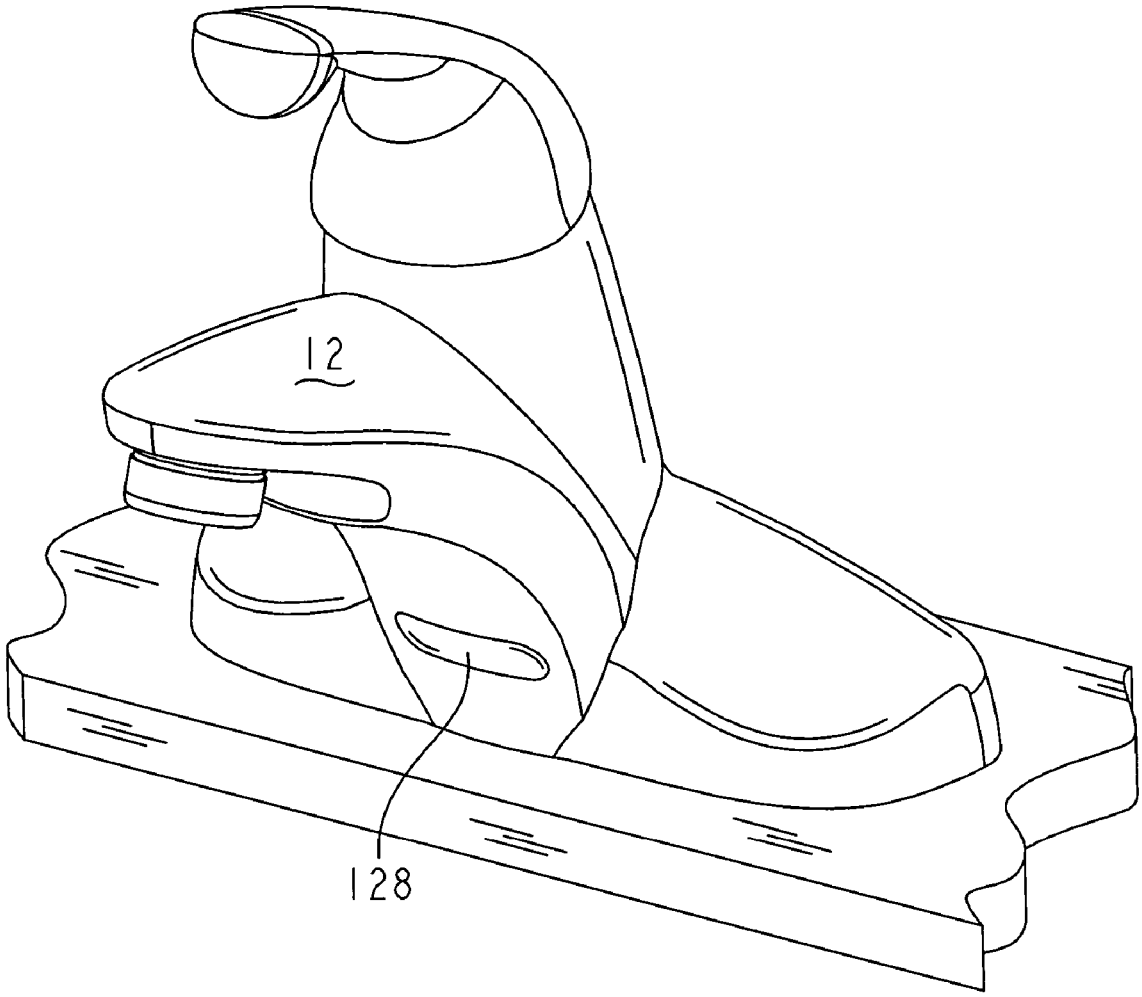
FIG. 3 is a perspective view of the spout and sensor of FIG. 1.
Figure 6:
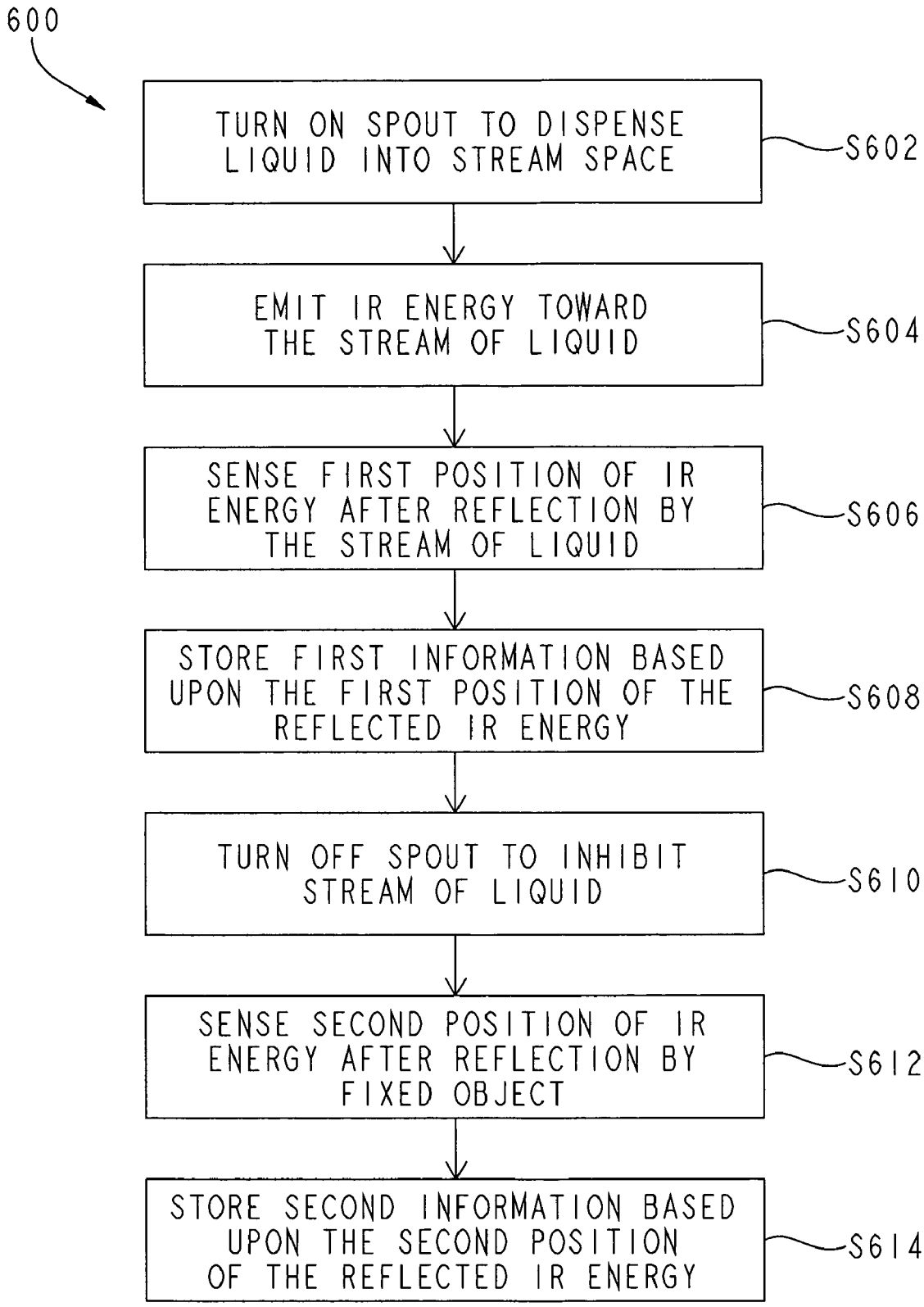
FIG. 6 is a flow chart of one embodiment of a method of performing the sensor calibration step of FIG. 5.

One particular embodiment of a method 600 of performing the sensor calibration step S502 is illustrated in FIG. 6. In a first calibration step S602, the spout is turned on to dispense liquid into the stream space. For example, valve 18 may be turned on in order to cause water to flow from spout 12 and through the stream space. Valve 18 may be turned on manually by an installer, or controller 16 may open valve 18 in a self-calibration process. In a next step S604, IR energy is emitted toward the stream of liquid. That is, emitter 24 may emit infrared energy along axis 32 toward stream of liquid 20. A first position of the IR energy after reflection by the stream of liquid may then be sensed in step S606. For example, as shown in FIG. 3, detector 30 may receive the reflected IR energy at location 66, and thereby sense the position of the IR energy after being reflected by stream of liquid 20 at position 64. More particularly, rather than a single reading of location 66, a plurality of sensor readings may be taken and averaged. That is, a plurality of readings of location 66 may be taken and an average reading for location 66 may be calculated. In a next step S608, first information based upon the first position of the reflected IR energy is stored. The first information may be calibration data in the form of the detected location 66 of reception of reflected IR energy. Alternatively, the first information may be some information derived from location 66, such as calibration data representing threshold position 68 as established based upon location 66 and/or position 64. The first information may be stored in a memory device 80 (FIG. 1) associated with controller 16, for example. In a next calibration step S610, the spout is turned off to inhibit the dispensing of stream of liquid 20 into the stream space. For example, valve 18 may be turned off in order to prevent water from flowing from spout 12 and through the stream space. Valve 18 may be turned off manually by an installer, or controller 16 may close valve 18 in a self-calibration process. A second position of the IR energy after reflection by an object that is fixed relative to sensor 14 may then be sensed in step S612. For example, as shown in FIG. 3, detector 30 may receive the reflected IR energy at location 36, and thereby sense the position of the IR energy after being reflected by basin 22. More particularly, rather than a single reading of location 36, a plurality of sensor readings may be taken and averaged. That is, a plurality of readings of location 36 may be taken and an average reading for location 36 may be calculated. In a next step S614, second information based upon the second position of the reflected IR energy is stored. The second information may be calibration data in the form of the detected location 36 of reception of reflected IR energy. Alternatively, the second information may be some information derived from location 36, such as calibration data representing threshold position 60 as established based upon location 36 and/or the sensed position of basin 22. The second information may be stored in memory device 80, for example.

Returning now to the control method 500 of FIG. 5, after the calibration step S502, operation may begin with valve 18 in the closed position and stream of liquid 20 consequently being absent. Infrared energy is emitted toward the stream space upon the commencement of operation of spout arrangement 10 (step S504). For example, emitter 24 may emit infrared energy toward the stream space that is occupied by stream 20 when stream 20 is flowing. In a next step S506, the position of the infrared energy is sensed after it is reflected. With stream of liquid 20 being off, the infrared energy may be reflected by some fixed object such as basin 22, and thus may be received at location 36 on detector 300. Based upon the sensed position of the reflected infrared energy, controller 16 may determine that no object to be rinsed, such as a user's hands, has entered basin 22. Controller 16 may then control the spout based on the position of the reflected infrared energy and the calibration data (step S508). For example, controller 16 may maintain valve 18 in the closed position based upon both the location on detector 30 at which the reflected infrared energy was received and the location on detector 30 corresponding to threshold position 60. Operation may then return to step S504 and the above-described process may repeat until an object closer to emitter 24 than threshold position 60 has been detected.

When a user's hand or other object has been placed in basin 22 at a position closer to emitter 24 than threshold position 60, then the infrared energy reflected by the hand may be received on detector 30 at a location 62 or at a location on detector 30 that is farther to the right in FIG. 3. Based upon the sensed position of the reflected infrared energy and calibration data associated with threshold position 60, controller 16 may determine that an object to be rinsed has been placed in basin 22. Consequently, in step S508, controller 16 may open valve 18 to thereby cause stream of water 20 to flow.

While stream of liquid 20 is flowing, the infrared energy may be emitted no farther than position 64 before being reflected. After opening valve 18, controller 16 may leave valve 18 open for a predetermined length of time, such as five seconds, for example, before examining the position of the reflected infrared energy and deciding whether to close valve 18. If sensor 14 senses that the infrared energy is being reflected at positions farther from emitter 24 than threshold position 68, then controller 16 may close valve 18. On the other hand, if sensor 14 senses that the infrared energy is being reflected at positions closer to emitter 24 than threshold position 68, then controller 16 may maintain valve 18 in the open position. For example, if a hand in stream 20 causes the effective position of reflection to be at position 76, then controller 16 may maintain valve 18 in the open position. After sensing a reflection position closer than threshold position 68, controller 16 may keep valve 18 open for at least a predetermined length of additional time, such as three seconds, for example.

Once a predetermined time has passed since a reflection position closer than threshold position 68 has been sensed, and controller has consequently closed valve 18, controller 16 may begin again comparing the reflection positions to threshold position 60 in deciding whether to re-open valve 18. The cycling of the process through steps S504, S506 and S508, as described above, may continue indefinitely.

In another embodiment, controller 16 does not base its control of spout 12 on a momentary position of the reflected infrared energy, but rather bases its control of spout 12 on detected movement of an object within basin 22. More particularly, controller 16 may open and close valve 18 based upon an amount of change in the position of the reflected infrared energy during a period of time. Because the signal from signal processor 42 may include noise, such as resulting from spectral reflection, controller 16 may require movement to be sensed between more than two points before making the determination that actual movement is occurring. Controller 16 may also require the sensed movement to continue for a predetermined length of time, such as one second, for example. It is also possible for controller 16 to filter out sensed movement that exceeds the speed capacity of the human hand. Controller 16 may filter out or ignore movement between two points that is sensed as being at a speed of greater than approximately one hundred miles per hour, for example.

While this invention has been described as having an exemplary design, the present invention may be further modified within the spirit and scope of this disclosure. This application is therefore intended to cover any variations, uses, or adaptations of the invention using its general principles.

What is claimed is:

1. A method of controlling a stream of liquid, comprising the steps of:

calibrating a PSD infrared sensor associated with a spout, said calibrating including the substeps of:

turning on the spout to thereby dispense a stream of liquid from the spout and into a stream space;

emitting infrared energy from said PSD infrared sensor and toward the stream of liquid;

sensing a first position of the infrared energy after the infrared energy has been reflected back to said sensor from the stream of liquid;

storing first information based upon the first position of the reflected infrared energy;

turning off the spout to thereby inhibit the liquid from being dispensed from the spout;

sensing a second position of the infrared energy after the infrared energy has been reflected back to said sensor from an object that is fixed relative to said sensor; and storing second information based upon the second position of the reflected infrared energy;

emitting infrared energy from said PSD infrared sensor and toward the stream space;

sensing a third position of the infrared energy after the infrared energy has been reflected back to said sensor; and controlling the spout dependent upon the first information, the second information and the third position.

2. The method of claim 1 wherein the calibrating substeps of turning on the spout and turning off the spout are performed automatically by a controller.

3. The method of claim 1 wherein the object comprises a basin into which the stream of liquid is dispensed.

4. The method of claim 1 wherein the first, second and third positions comprise respective locations on a receiver of said sensor on which the reflected infrared energy impinges.

5. The method of claim 1 wherein the controlling of the spout comprises:

turning on the spout dependent upon a relationship between the third position and a first threshold position; and turning off the spout dependent upon a relationship between the third position and a second threshold position, the second threshold position being different from the first threshold position.

6. A method of controlling a stream of liquid, comprising the steps of:

calibrating a PSD infrared sensor associated with a spout, said calibrating including the substeps of:

turning on the spout to thereby dispense a stream of liquid from the spout;

emitting infrared energy from said PSD infrared sensor and toward the stream of liquid;

sensing a first position of the infrared energy after the infrared energy has been reflected back to said sensor from the stream of liquid; and storing first information based upon the first position of the reflected infrared energy;

turning on the spout after said calibrating step to thereby dispense a stream of liquid from the spout;

sensing, with the spout turned on, a second position of the infrared energy after the infrared energy has been reflected back to said sensor; and deciding whether the spout should be turned off, said deciding being dependent upon the first information and the second position.

7. The method of claim 6 wherein a plurality of said second positions are sensed at different respective points in time, said deciding step being dependent upon each of the second positions.

8. The method of claim 7 wherein said deciding step is dependent upon a mathematical relationship between the second positions.

9. The method of claim 8 wherein said deciding step is dependent upon a difference between two of the second positions.

10. The method of claim 8 wherein said deciding step is dependent upon an average of the second positions.

11. The arrangement of claim 7 wherein said controller is configured to move said spout between the on position and the off position dependent upon a mathematical relationship between the sensed positions.

12. The method of claim 6 wherein said deciding step is dependent upon a difference between the first position and the second position.

13. A spout arrangement, comprising:

a spout having an on position in which said spout dispenses a stream of liquid into a stream space and an off position in which the dispensing of the stream of liquid is inhibited;

a PSD infrared sensor configured to:

emit infrared energy toward the stream space; and sense a position of the infrared energy after the infrared energy has been reflected back to said sensor; and a controller in communication with said spout and with said sensor, said controller being configured to:

store information based upon a position of the reflected infrared energy sensed by said sensor during calibration when the stream of liquid is in the stream space; and turn said spout to the off position dependent upon the stored information and a position of the reflected infrared energy sensed by said sensor during operation.

14. The arrangement of claim 13, wherein the stored information is also based upon a position of the reflected infrared energy sensed by said sensor during calibration when the stream of liquid is absent from the stream space, said controller being configured to turn said spout to the on position dependent upon the stored information and a position of the reflected infrared energy sensed by said sensor during operation.

15. The arrangement of claim 14, wherein said controller is configured to turn said spout to the off position during the calibration.

16. The arrangement of claim 13, wherein said controller is configured to turn said spout to the on position during the calibration.

17. A spout arrangement, comprising:

a spout having an on position in which said spout dispenses a stream of liquid into a stream space and an off position in which the dispensing of the stream of liquid is inhibited;

an infrared sensor including an emitter configured to emit infrared energy toward the stream space, and a receiver configured to sense a position of the infrared energy after the infrared energy has been reflected back to said sensor; and a controller in communication with said spout and with said sensor, said controller being configured to:

store first information based upon a first position of the reflected infrared energy sensed by said sensor during calibration when the stream of liquid is in the stream space;

store second information based upon a second position of the reflected infrared energy sensed by said sensor during calibration when the stream of liquid is absent from the stream space; and move said spout between the on position and the off position dependent upon the stored first information, the stored second information, and a position of the reflected infrared energy sensed by said sensor during operation.

18. The arrangement of claim 17, wherein the stream of liquid impinges on a basin, the infrared energy being reflected by said basin during calibration when the stream of liquid is absent from the stream space.

19. The arrangement of claim 17 wherein said controller is configured to move said spout between the on position and the off position dependent upon a plurality of positions sensed by said sensor at different respective points in time during operation.

20. The arrangement of claim 19, wherein said controller is configured to move said spout between the on position and the off position dependent upon a mathematical relationship between the sensed positions.

* * * * *